United States Patent [19]

Cole et al.

[11] 4,271,895

[45] Jun. 9, 1981

[54] AUTOMATIC PART LOADER UNIT FOR MULTI-CAVITY ROTOR DIE AND METHOD OF OPERATION

[75] Inventors: James C. Cole, Galion; George F. Cronenwett, Mount Gilead, both of Ohio

[73] Assignee: HPM Corporation, Mount Gilead, Ohio

[21] Appl. No.: 115,770

[22] Filed: Jan. 28, 1980

[51] Int. Cl.[3] ..... B22D 17/00; B22D 19/04

[52] U.S. Cl. ..... 164/109; 164/303; 164/332

[58] Field of Search ..... 164/109, 110, 112, 303, 164/332, 333

[56] References Cited

U.S. PATENT DOCUMENTS

| | | | |
|---|---|---|---|
| 3,608,622 | 9/1971 | Bachelier | 164/303 |
| 4,064,928 | 12/1977 | Wunder | 164/332 X |

*Primary Examiner*—Robert D. Baldwin

*Attorney, Agent, or Firm*—Albert L. Jeffers; John F. Hoffman

[57] ABSTRACT

An automatic part loading unit for loading various diameter and stack height sizes of rotor assemblies into the compensator sleeves of multiple cavity rotor dies for the subsequent casting of the conductor bars and end rings of squirrel cage electrical motor rotors. The loading unit comprises a magazine section having a plurality of inclined guide tracks on which the rotor preforms are stacked, and an escapement mechanism which permits one rotor preform at a time to roll from each of the guide tracks in the magazine section onto respective inclined guide tracks leading to the breech openings of the die cavities. The guide tracks are laterally adjustable so as to accommodate rotor preforms of various stack height. As the rotor preforms roll down the inclined guide track toward the die cavities, they are decelerated by means of pivotally mounted, counterweighted arms which are contacted by and then swung out of the way by the rotors. The rotors are magnetically held in the proper position within the compensator sleeves, and photoelectric sensors provide an indication of whether or not proper positioning has been achieved. The compensator sleeves are closed and molten aluminum is cast around a portion of the rotor preforms to form the end rings and conductor bars.

20 Claims, 12 Drawing Figures

AUTOMATIC PART LOADER UNIT FOR MULTI-CAVITY ROTOR DIE AND METHOD OF OPERATION

BACKGROUND OF THE INVENTION

The present invention relates to an automatic loading method and mechanism for loading preformed parts, such as the stacked laminations of a motor rotor, into the die cavities of a die casting machine.

In the manufacture of squirrel cage rotors for electric motors, it is common practice to form them of a plurality of stacked, circular laminations each having a central opening and a plurality of openings positioned in a circular array near the peripheral edge of the lamination. The laminations are stacked on a stacking pin with a slight skew or no skew to the circular array of openings from one lamination to the next so that the openings collectively form a plurality of partially helical passages or channels axially through the stacked laminations.

These rotor preforms are then loaded into the die cavities of a die casting machine, and molten aluminum is injected into the cavity whereupon it flows through the skewed channels in the stack of laminations to form the conductor bars and to form end rings on opposite ends of the stack of laminations, which provide electrical interconnection between the conductor bars. The end rings may either be formed smooth or with fins for the purpose of cooling. The formed rotor is then removed from the die casting machine, and the stacking pins are pressed out so that the rotor assembly is held together by means of the cast aluminum end rings and conductor bars.

In the past, the rotor preforms have either been loaded into the die cavities by hand or by means of a cumbersome, complex rotary loader mechanism.

SUMMARY OF THE INVENTION

The loading unit according to the present invention comprises a gravity-fed magazine section having a plurality of downwardly inclined guide tracks, which feed the preformed parts, such as motor rotors, toward an escapement mechanism. A plurality of parts can be stacked on the guide tracks at one time so that minimal operator attention is required to ensure an adequate supply of rotors to the machine.

A shuttle or escapement mechanism is positioned between the magazine section and the inclined guide tracks, the latter leading to the compensator sleeves into which the parts are loaded through a breech opening. The escapement mechanism allows only one rotor at each of the stations to be fed from a magazine section onto its respective guide track. When the escapement mechanism is cycled, one part is permitted to roll from the magazine section into the transfer section between the front and rear stop blocks, and when the escapement mechanism is moved through the last increment of its cycle, the part is permitted to roll from the transfer section past the rear stop and onto the guide tracks leading to the compensator sleeves. The escapement mechanism is preferably cycled in a rectilinear fashion in the vertical direction by means of a hydraulic cylinder.

The parts move down the inclined guide tracks by gravity, and are decelerated just prior to moving into the compensator sleeves by means of a gate assembly comprising a pivotally mounted arm which is swung upwardly by the parts as they move against and past it. Weights can be added to the arm to provide the optimum deceleration for parts of various weights.

The rotors are held in the proper position within the compensator sleeves by means of magnets, and a faulty load condition is sensed by means of a photoelectric sensor, or the like, which may be connected to prevent further machine cycling. The pivotally mounted arms are provided with upturned ends, which serve to prevent the parts from bouncing back out of the compensator sleeves as they are loaded.

In the case of loading motor rotors, the guide tracks in the magazine, transfer and load sections are laterally adjustable so that the spacing between them can be adjusted to accommodate rotors of various stack heights. The pivotally mounted decelerating arm is preferably provided with guide tracks on its lower surface to prevent narrow stack height rotors from tipping as they roll from the downwardly inclined guide tracks into the breech openings of the die cavities.

Specifically, the present invention contemplates a die casting machine including at least one die cavity having an opening communicating with the cavity through which parts are loaded into the die cavity for incorporation into a casting, and a loading mechanism for loading the parts into the cavity through the opening. The loading mechanism comprises a magazine for supporting a plurality of parts and for advancing the parts along a first portion of a feed path to the die cavity opening, and a guide track defining a second portion of the feed path to the cavity opening and having one end thereof aligned with and in close proximity to the cavity opening such that parts moving off the end of the guide track in the feed path will move through the cavity opening. A selectively actuatable escapement mechanism is positioned in the feed path and generally disposed between the magazine and the guide track for permitting only one part at a time to advance from the magazine to the guide track each time it is actuated.

The invention also relates to a method for loading preformed parts in a die casting machine and incorporating the part in a casting comprising providing a die cavity having a breach opening, loading a plurality of the preformed parts in a magazine, moving one part at a time by gravity from the magazine through an escapement mechanism and onto an inclined guide track, moving the part down the inclined track toward and through the breach opening into the die cavity, and then introducing molten metal into the cavity to cast around at least a portion of the part loaded therein. In a preferred embodiment of the invention, the parts are motor rotors comprising a stack of laminations held together by means of a stacking pin, and wherein the rotors roll by gravity from the magazine, through the escapement mechanism and into the die cavities.

It is an object of the present invention to provide a mechanism for loading parts, especially rotors for electric motors, into a die casting machine wherein the loading is accomplished automatically with minimal operator intervention.

This object is accomplished by providing a gravity fed magazine and an escapement mechanism which permits only one rotor at a time to move from the magazine section onto each of the guide tracks leading from the escapement mechanism to the die cavities.

It is a further object of the present invention to provide an automatic loader for a die casting machine wherein the parts are loaded by gravity into the compensator sleeves, and wherein means are provided for decelerating the parts as they move from the load trays into the die cavities so as to prevent bouncing and tipping of the parts, which may result in improper positioning.

A still further object of the present invention is to provide a loader for loading electric motor rotors into a die casting machine wherein the rotors are properly positioned within compensator sleeves by magnets associated with the compensator sleeves, and wherein improper positioning is automatically sensed.

Yet another object of the present invention is to provide a mechanism whereby a plurality of parts can be simultaneously loaded into the compensator sleeves of a die casting machine.

These and other objects and features of the present invention will become apparent from the description of the preferred embodiment taken in conjunction with the accompanying drawings.

DESCRIPTION OF THE PREFERRED EMBODIMENT

Figure 1:
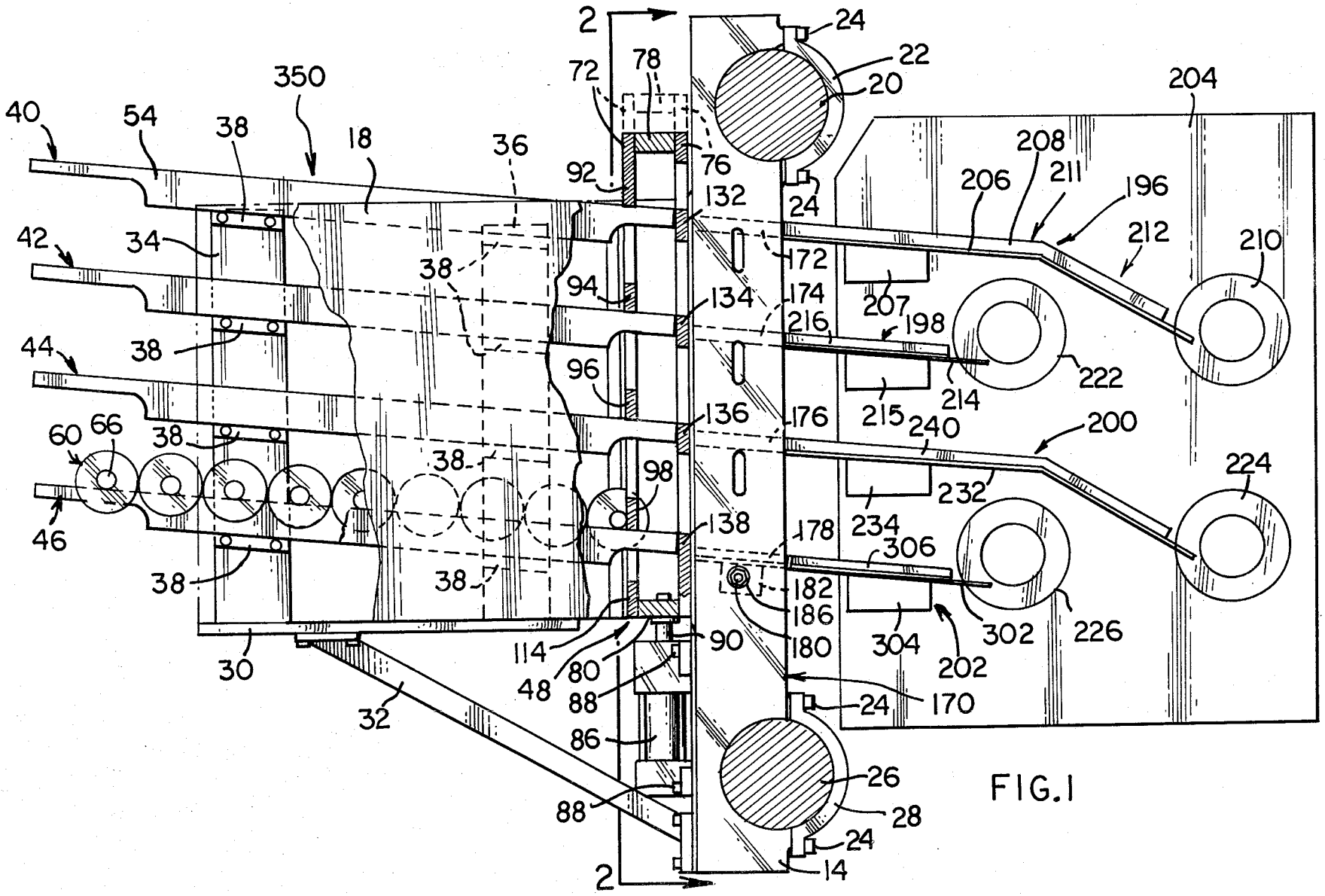
FIG. 1 is a side elevational view, partially in section, of the rotor loading mechanism of the present invention.
Figure 2:
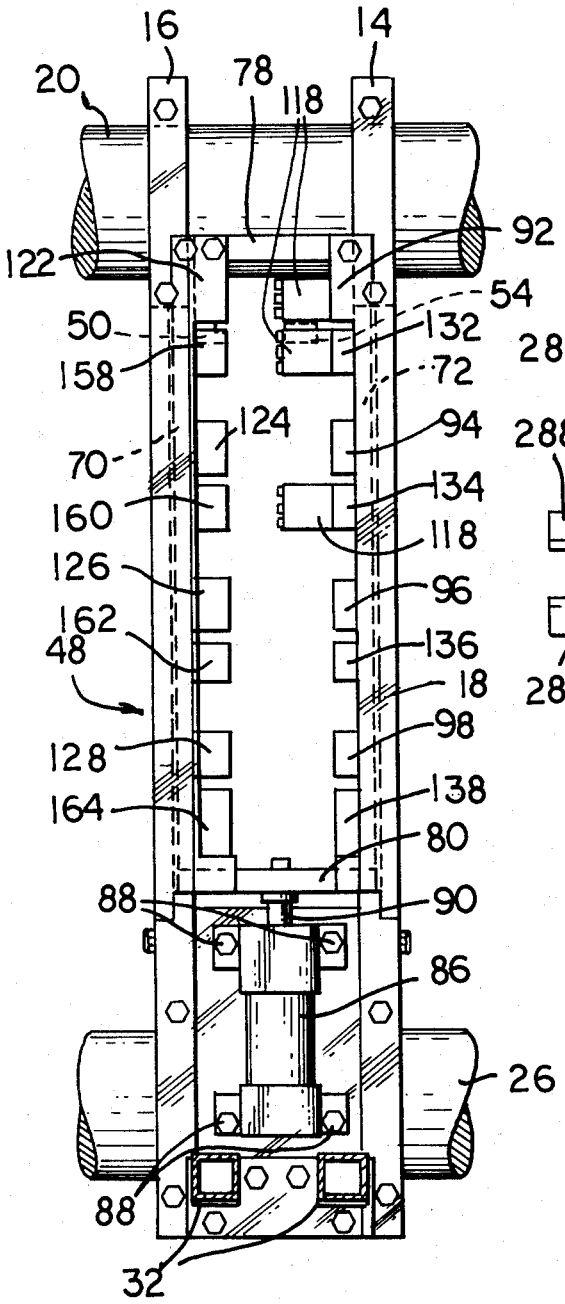
FIG. 2 is a sectional view taken along line 2—2 of FIG. 1 and viewed in the direction of the arrows with portions thereof removed for clarity.
Figures 3, 4:
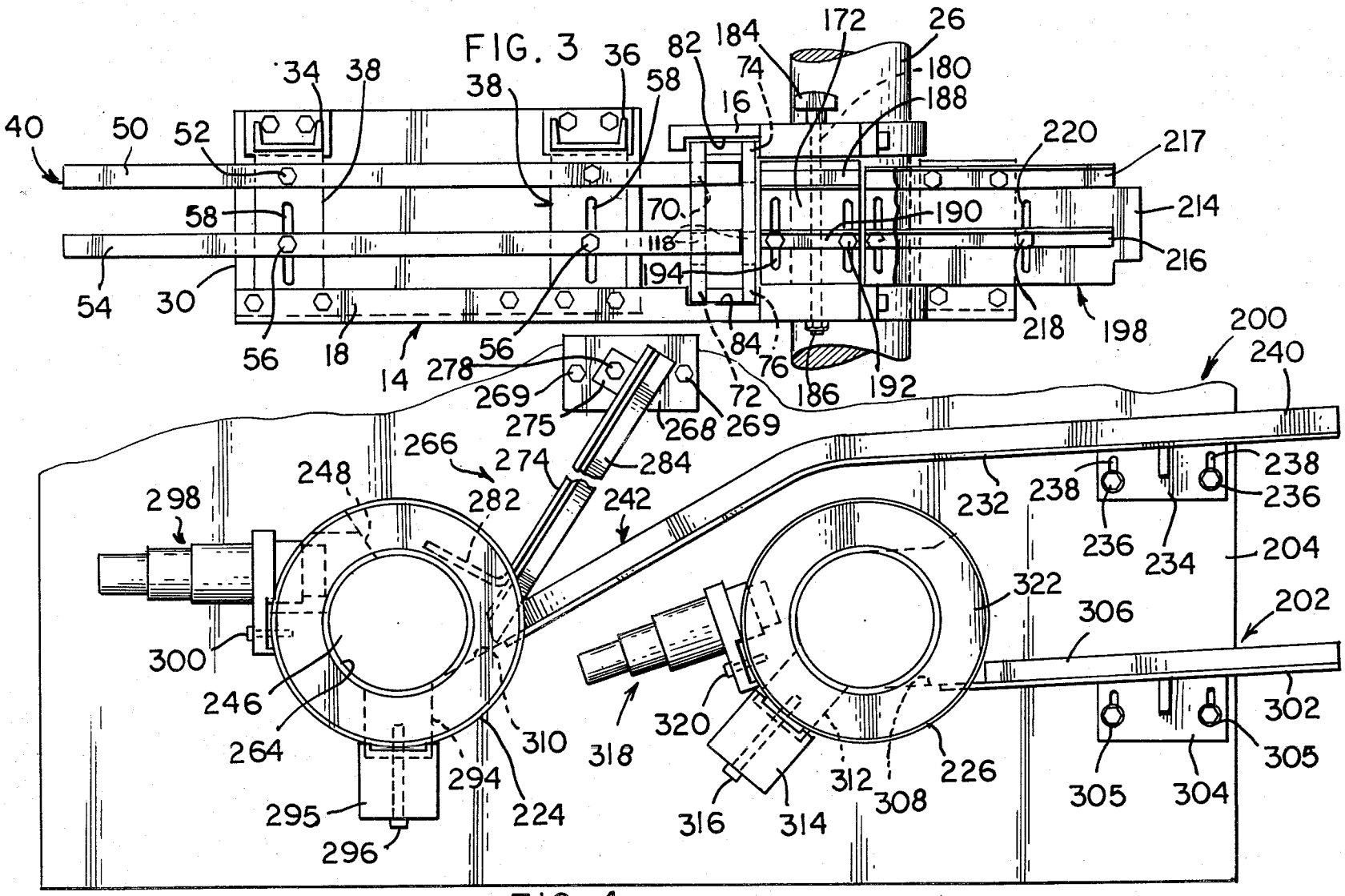
FIG. 3 is a top view of the mechanism.
FIG. 4 is an enlarged side elevational view of two of the compensator sleeves and guide tracks leading thereto.

With reference now to the drawings, and in particular FIGS. 1, 2 and 3, the rotor loading mechanism of the present invention comprises a pair of side frame members 14 and 16, wherein frame member 14 extends rearwardly and includes a side guard portion 18. Side frame members 14 and 16 are secured to upper tie rod 20 by means of cap 22, which is secured to frame members 14 and 16 by screws 24. In a similar fashion, frame members 14 and 16 are clamped to lower tie rod 26 by cap 28, which is secured to frame members 14 and 16 by screws 24. A lower support plate 30 is connected to side frame members 14 and 16 by bracket 32, the latter being bolted to side members 14 and 16 and lower support plate 30.

Two columns 34 and 36 are rigidly secured to lower support plate 30, and are connected to side frame member 14 by eight shelves 38, which are screwed thereto. Four pairs of guide tracks 40, 42, 44 and 46 are rigidly connected to shelves 38 and are inclined slightly downwardly in the feed direction toward the escapement mechanism indicated generally as 48. Each of the guide track 42, 44 and 46 are similar and have the same structure as guide track 40, which is illustrated in somewhat greater detail. Guide track 40 comprises a first guide rail 50 (FIG. 3) which is rapidly secured to shelves 38 by bolts 52, and an adjustable guide rail 54, which is also secured to the upper shelves 38 by bolts 56, which extend through slots 58 in shelves 38. The guide rails 50 and 54 are maintained so that they are always parallel to each other, and the lateral adjustment capability of rail 54 enables the guide track 40 to be adjusted for rotors of varying stack heights.

Figure 8:
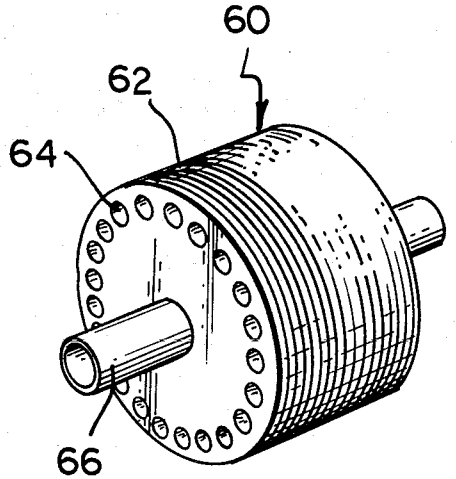
FIG. 8 is an enlarged, perspective view of one of the rotor preforms.

FIG. 8 illustrates a rotor preform 60, which comprises a stack of circular laminations 62 made of steel or iron and having a plurality of openings 64 therein which are disposed in a circular array. Laminations 62 are pressed over a central tubular stacking pin 66 or solid cylindrical pin, and the openings 64 of one lamination 62 are skewed slightly with respect to the next lamination so that a partially helical channel or passage is formed down through the stack of laminations 62 in most cases. However, in some instances these openings may be in line with respect to all laminations (no skew). Rotor preform 60 may be of varying diameters and stack height, depending on the requirements of the motor. FIG. 1 illustrates a plurality of such rotors 60 supported on the lower guide track 46, and a similar set of rotors (not shown) would be supported on the other guide track pairs 44, 42 and 40. The stacking pins 66 of the rotor 60 are actually supported on the guide rails, such as rails 50 and 54, and the laminations 62 are disposed between the rails making up the guide tracks 40, 42, 44 and 46.

The rear end of guide tracks 40, 42, 44 and 46 extend into the escapement mechanism 48 so as to convey the rotors 60 thereto. Escapement mechanism 48 comprises four stop plates 70, 72, 74 and 76 rigidly connected together at the top by spacer 78 and at the bottom by spacer 80, so that all of the stop plates move together as a unit. Stop plates 70, 72, 74 and 76 are slidably received in the generally U-shaped openings 82 and 84 inside frame members 16 and 14, respectively. A hydraulic cylinder 86 secured to frame members 14 and 16 by screws 88, has its plunger rod 90 secured to lower spacer 80. When hydraulic fluid is admitted to one side of the hydraulic cylinder, stop plates 70, 72, 74 and 76 will be raised to the dotted line position illustrated in FIG. 1, and when hydraulic fluid is admitted to the other side, it will be lowered to the solid line position.

Figure 10:
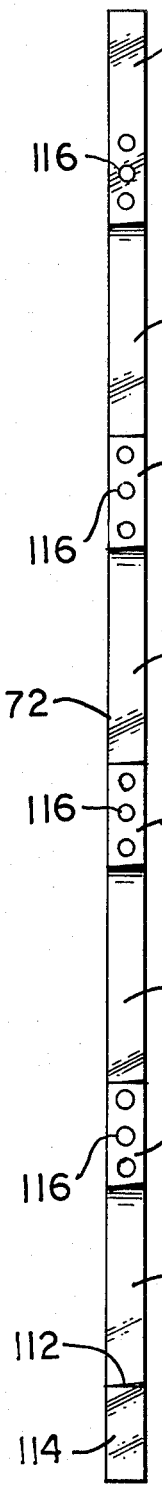
FIG. 10 is a side elevational view thereof.
Figure 9:
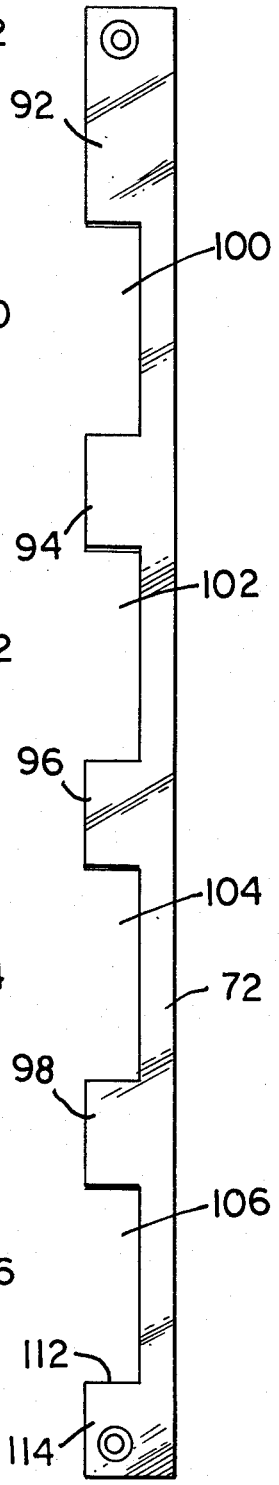
FIG. 9 is an enlarged front elevational view of the right front stop plate as viewed in FIG. 2.

FIGS. 9 through 12 illustrate the stop plates in greater detail. Specifically, FIGS. 9 and 10 are elevated views of the front right stop plate 72, which is made of steel and machined so as to form stops 92, 94, 96 and 98 openings 100, 102, 104 and 106. Stops 92, 94, 96 and the upper surface 112 of lower portion 114 are inclined slightly from front to back, as best illustrated in FIG. 10. The side edges of the stops 92 are provided with tapped screw sockets 116 and reamed holes for dowel pins to enable the attachment of stop blocks, such as blocks 118 illustrated in FIG. 2. The left front stop plate 70 is very similar to stop plate 72, except that it is a mirror image and the stops 122, 124, 126 and 128 are slightly longer (FIG. 2). In most cases, it is not necessary to provide for the addition of stop blocks 118 on stop plate 70.

Figure 12:
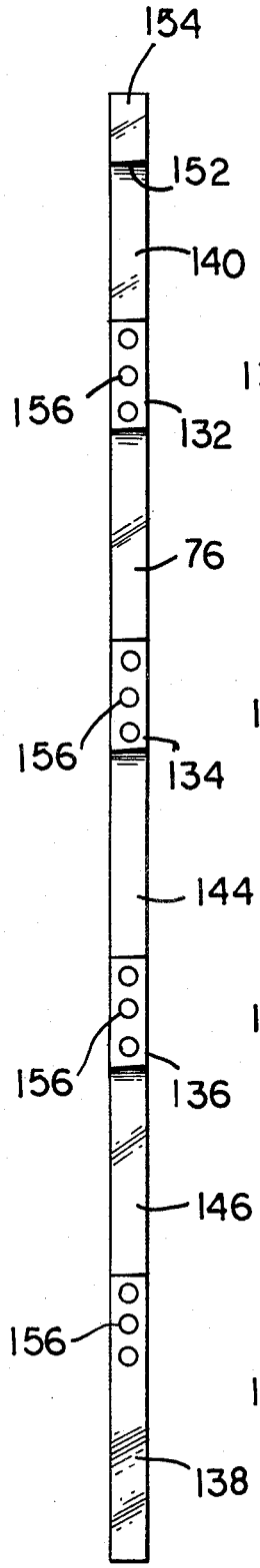
FIG. 12 is a side elevational view thereof.
Figure 11:
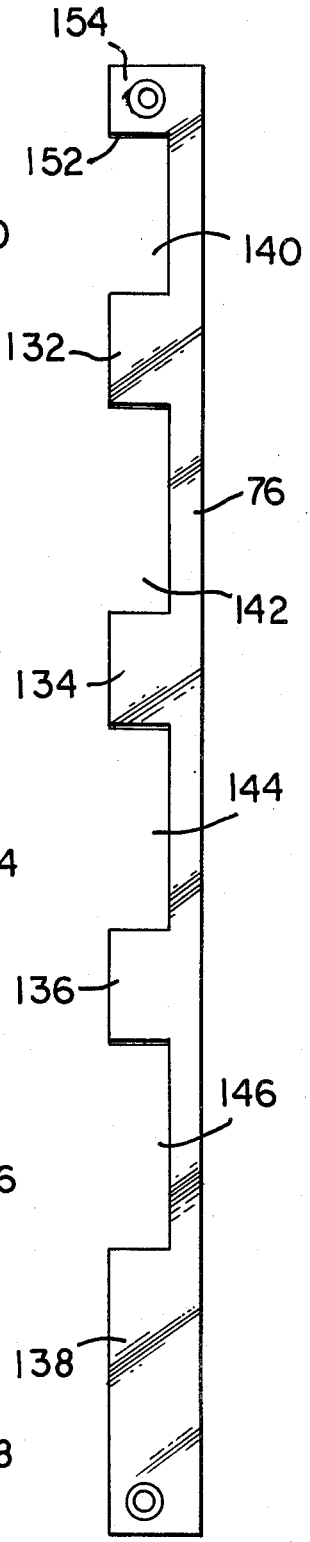
FIG. 11 is an enlarged front elevational view of the right, rear stop plate as viewed in FIG. 2.

FIGS. 11 and 12 illustrate in detail the rear right stop plate 76, which is made of the same material as stop plates 72 and 70, and comprises four stops 132, 134, 136 and 138 separated by openings 140, 142, 144 and 146. It will be noted that stops 132, 134, 136 and 138, and the lower surface 152 of upper portion 154 are inclined slightly from front to rear as illustrated best in FIG. 12. Threaded screw sockets 156 and reamed holes for dowel pins are provided for the attachment of stop locks such as 118 and 120. The left rear stop plate 74 is very similar to stop plate 76, except that it is a mirror image and the stops 158, 160, 162 and 164 are slightly longer as illustrated in FIG. 2.

FIG. 2 shows the relationship of front stop plates 70 and 72 and rear stop plates 74 and 76 on FIG. 3 when the escapement mechanism 48 is in its lower position. Guide rails 50 and 54 are shown in dotted line so as to avoid obscuring the structure of the escapement mechanism 48. In the lower position of mechanism 48, it will be seen that stop 122 and stop block 118 will be positioned directly in the path of rotors 60 supported on rails 50 and 54. The same would be true of the other guide track pairs 42, 44, and 46, although neither they nor all of their associated stop blocks 118 have been illustrated, for the sake of clarity. FIG. 1 illustrates the manner in which front stops 92, 94, 96, 98, 122, 124, 126 and 128 are positioned such that they block rotors 60 from moving past them when the escapement mechanism is in the lower position. In this position, it will be noted that rear stops 132, 134, 136, 138, 158, 160, 162 and 164 are in their lower positions so that rotors 60 could roll past them. When the escapement mechanism is raised by actuating hydraulic cylinder 86, front stops 92–98 and 122–128 are raised so that the four rotors located on the respective guide tracks 40, 42, 44 and 46 can roll beneath them. In this position, however, rear stops 132–138 and 158–164 are raised so that the rotors 60 will be blocked from further movement. When hydraulic cylinder 86 is retracted and the escapement mechanism is lowered, however, rear stops 132–138 and 158–164 will again be lowered so that the rotors 60 in abutment with them can roll past them and into the transfer section 170.

Transfer section 170 comprises four trays 172, 174, 176 and 178, which are pivotally connected to side frame members 14 and 16 by shafts 180. Shafts 180 are connected to their respective trays 172, 174, 176 and 178 by brackets 182 and turned by means of knobs 184. The tray assemblies are retained in place on frame members 14 and 16 by nuts 186 threadedly secured to the ends of shafts 180.

Rigidly connected to each of the trays 172, 174, 176 and 178 is a stationary guide rail 188, and a laterally adjustable guide rail 190 is secured to its respective tray 172, 174, 176 and 178 by bolts 192 extending through slots 194. Rail 190 is adjusted relative to rail 188 so as to accommodate the stack height for the particular rotors being loaded.

Load guide track assemblies 196, 198, 200 and 202 (FIGS. 1 and 2) are secured to a frame member 204. Guide track assembly 196 comprises a load tray 206 secured to frame member 204 by bracket 207, and a pair of guide rails 208 secured to load tray 206. Guide rails 208 are parallel and spaced apart by the stack height of the rotor 60 and lead to compensator cylinder 210. It will be noted that guide track assembly 196 includes a first portion 211 which is inclined at about the same angle of inclination as guide tracks 40, 42, 44 and 46 and a second section 212, which has a steeper inclination.

Guide track assembly 198, which is also shown in the broken away portion of FIG. 3, comprises a shorter load tray 214 secured to frame member 204 by bracket 215, and a pair of parallel guide rails 216 and 217, which are spaced apart similarly to guide rails 208. In the case of each guide track assembly, the right hand guide rail, such as rail 216, relative to the direction of movement of rotors 60 is adjustably mounted to its respective tray 215, for example, by bolts 218 extending through slots 220. This permits adjustment of the guide rails to accommodate the stack height of the rotors being loaded. Load tray 214 and guide rails 216 lead to compensator sleeve 222.

Guide track assembly 200 is constructed similarly to assembly 196, and leads to compensator sleeve 224. Guide track assembly 202 is constructed similarly to assembly 198 and leads to compensator sleeve 226. For the sake of clarity, FIG. 3 illustrates only one guide track assembly 198, although the structure of the other assemblies 196, 200 and 202, particularly with regard to the adjustability of the right hand guide rail, are very similar.

With reference to FIG. 4, the manner in which the guide track assemblies 196, 198, 200 and 202 lead to their respective compensator sleeves 210, 222, 224 and 226 is shown. Although only the structure for the lower guide track assemblies 200 and 202 have been illustrated, the structure for the upper two is identical. Guide track assembly 200 comprises a load tray 232, which is connected to frame member 204 by bracket 234. It will be noted that bracket 234, like brackets 207 and 215, is adjustably secured to member 204 by virtue of bolts 236 being received in slots 238. Guide rails 240 are secured to load tray 232, with the right-hand guide rail 240 being adjustably mounted similarly to guide rails 216 and 217. It will be noted that the portion 242 of guide rails 240 which lead directly to compensator sleeve 224 has a much greater inclination than does the more rearward portion. This is necessitated by the location of the compensator sleeves 224 and 226, which are generally in the same horizontal plane.

Figure 7:
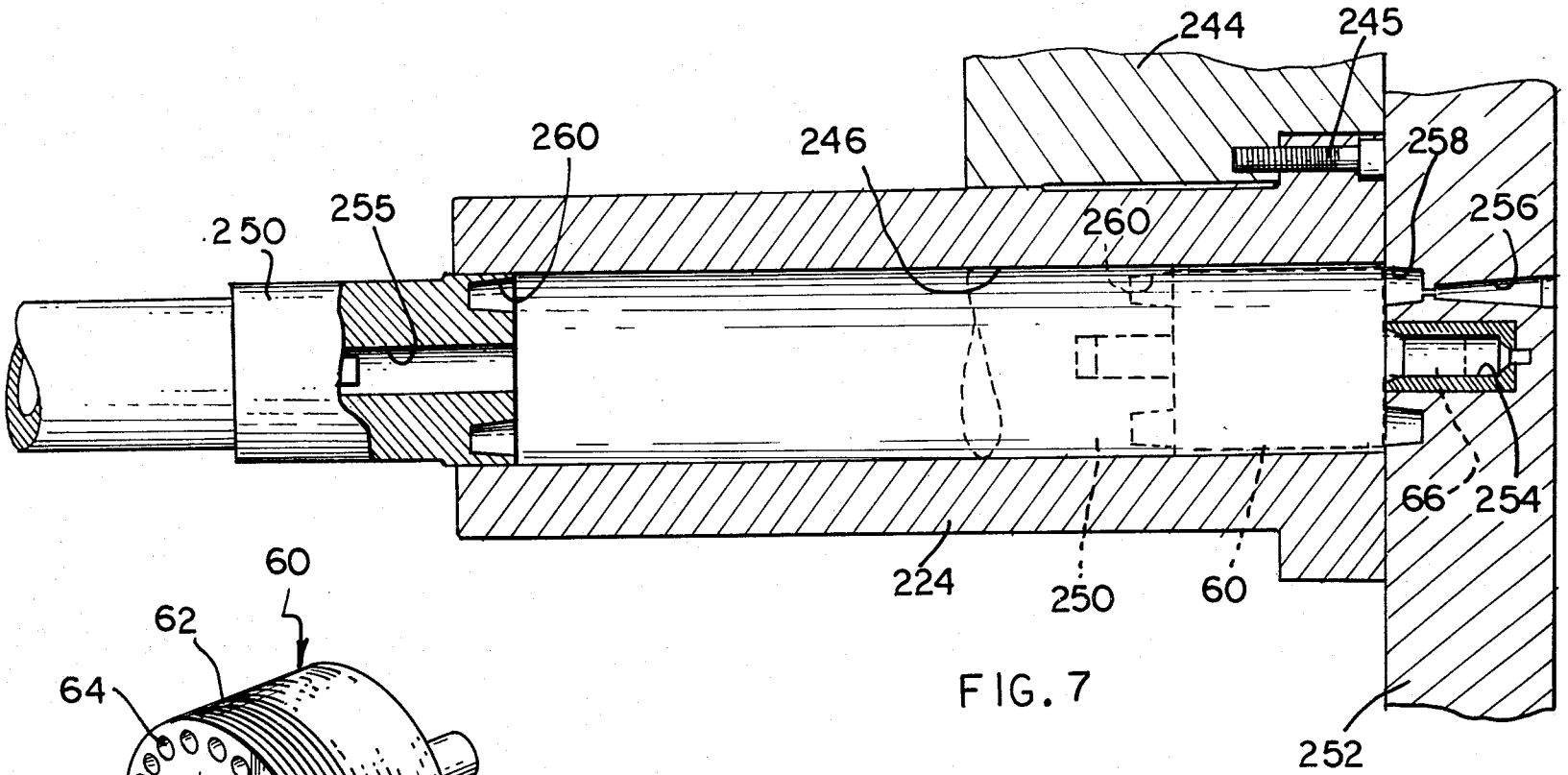
FIG. 7 is an enlarged, fragmentary, sectional view of one of the compensator sleeves showing a rotor preform received therein and wherein the compensator is shown in both its rearward and forward positions.

Compensator sleeve 224, which is illustrated in FIGS. 4 and 7, is the mechanism of the die casting machine die within which the end rings and conductor bars are cast on the rotor preform 60. Sleeve 224 is rigidly secured to plate 244 by screws 245, and includes a generally cylindrical chamber 246. The rotor preform 60 rolls by gravity down load tray 232, through opening 248 and into the cylindrical chamber 246 of sleeve 224. Compensator plunger 250 is then advanced to the dotted line position shown in FIG. 7, thereby pushing the rotor preform 60 forwardly in chamber 246 against plate 252. Preform 60 is compressed between plunger 250 and plate 252 so that the laminations 62 are pressed tightly together, thereby preventing the molten aluminum from flowing between the laminations 62. Guide pin 66 is received in recesses 254 and 255. At this point, molten aluminum is injected through sprue 256, into the annular end ring chamber 258, which forms one end ring, through the openings 64 in laminations 62 so as to form the conductor bars, and then into annular end ring cavity 260, which forms the opposite end ring. Following casting, the fully cast rotor is ejected from the chamber 246, and the stacking pin 66 is pressed out. Plunger 250 then retracts so as to clear opening 248, and four more rotor preforms 60 are loaded. Since this is a four station die casting machine, the above-described sequence occurs simultaneously in each of the compensator sleeves 210, 222, 224, and 226.

Figure 5:
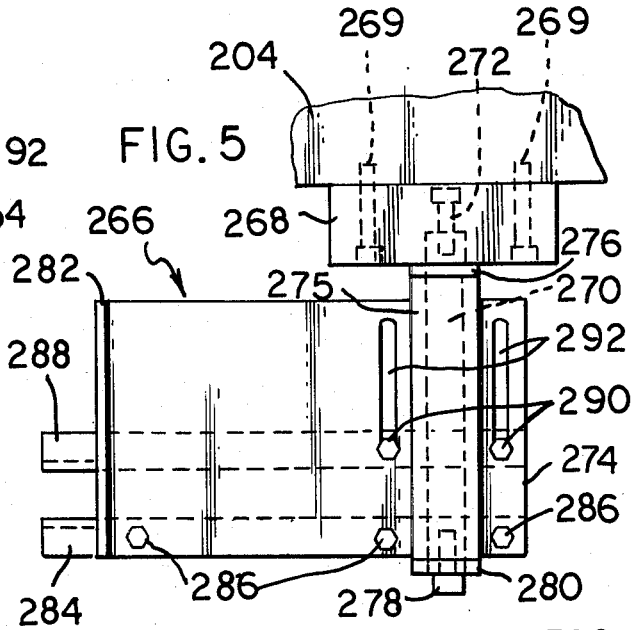
FIG. 5 is a top view of one of the deceleration arm mechanisms of FIG. 4.

Due to the relatively steep incline of the forward portion 242 of guide track assemblies 200 and 196, the rotor preforms 60 tend to bounce back when they strike the inner walls 264 of sleeves 224 and 210. To decelerate the rotor preforms 60 as they roll down load trays 206 and 232, a deceleration arm assembly is provided for each of these two stations. With reference to FIGS. 4 and 5, the deceleration arm assembly 266 for sleeve 224 is illustrated, and an identical arm assembly is provided for sleeve 210.

Arm assembly 266 comprises a pivot block 268 secured to frame member 204 by screws 269, and a pivot pin 270 connected to pivot block 268 by screw 272. Arm 274 includes a block portion 275, which is rotatably received over pin 270, and is spaced from pivot block 268 by washer 276. Block portion 275 is secured to pivot pin 270 by screw 278, and spaced therefrom by washer 280.

Arm 274 includes an upturned end portion 282, which, when arm 274 is in its lower position as illustrated in FIG. 4, blocks opening 248 so as to prevent the rotor preform 260 from bouncing out. A first guide rail 284 is connected to the underside of arm 274 by screws 286, and guide rail 288 is adjustably connected thereto by screws 290, which extend through slots 292. Guide rail 288 is laterally adjustable so as to accommodate rotor preforms 60 of varying stack height.

Arm 274 is normally in the position illustrated in FIG. 4 wherein guide rails 284 and 288 rest on guide track assembly 200. As the rotor preform 60 rolls down load tray 232, it contacts arm 274, and its momentum causes arm 274 to rotate clockwise as viewed in FIG. 4. Because part of the momentum of rotor 60 is imparted to arm 274, the linear speed of rotor 60 as it rolls into compensator sleeve 224 is lessened substantially, thereby minimizing bouncing and tipping of the rotor 60. Once rotor 60 has cleared arm 274, it drops down to its normal position. If desired, weights (not shown) can be added to arm 274 to increase the amount of deceleration of rotor 60, depending on its weight.

In order to ensure that the rotor preform 60 is properly positioned within sleeve 224, a holding magnet 294 is retained within sleeve 224 by magnet retainer 295, the latter held in place by screws 296. As rotor 60 rolls into sleeve 224, it will be attracted by magnet 294 so as to minimize bouncing and reduce the chance for tipping of the rotor 60. A photoelectric sensor 298, which may be of any commercially available variety such as a NAMCO photoelectric switch, is secured to sleeve 224 by screws 300. Sensor 298 detects the proper positioning of the rotor 60 within sleeve 224, and transmits an enabling signal to the control circuitry for the die casting machine permitting the casting sequence to resume once the rotors 60 are loaded. Compensator sleeve 210 also includes a holding magnet and photoelectric sensor identical to that shown in FIG. 4.

Guide track assembly 202 comprises a load tray 302 secured to frame member 204 by bracket 304 and screws 305. A pair of guide rails 306, one of which is laterally adjustable, are secured to the upper surface of load tray 302. It will be noted that load tray 302 as well as load tray 232 are in alignment with the lower surfaces 308 and 310 of sleeves 226 and 224, respectively. This enables the rotors 60 to roll into their respective sleeves without bouncing.

Compensator sleeve 226 includes a holding magnet 312 secured therein by retainer 314 and screw 316. A photoelectric sensor 318, similar to sensor 298, is connected to sleeve 226 by screws 320. As the rotor 60 rolls into sleeve 226 through opening 322, holding magnet 312 will pull it into proper position, and the proper positioning of the rotor 60 is sensed by photoelectric switch 318. Compensator sleeve 222 includes a holding magnet and photoelectric switch identical to magnet 312 and switch 318.

Figure 6:
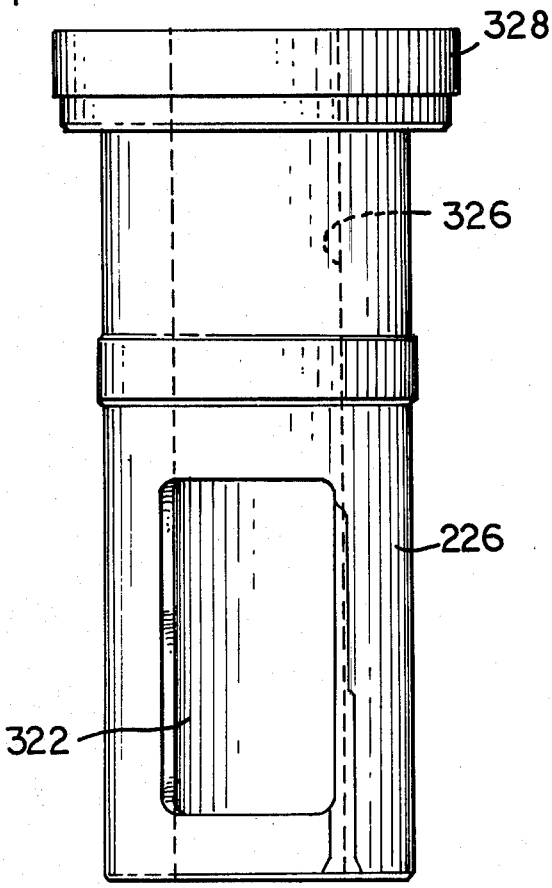
FIG. 6 is a top view of one of the compensator sleeves.

FIG. 6 illustrates compensator sleeve 236 wherein the rotor 60 is loaded therein through opening 322 and pressed forwardly in cylindrical chamber 326 by the plunger (not shown) until it is pressed into abutment with the plate 252 adjacent flange 328.

The following is the operating sequence of the apparatus. Initially, a plurality of rotor preforms 60 are loaded on guide tracks 40, 42, 44 and 46 (FIG. 1) and, due to the inclination of the guide tracks, the rotors 60 will roll forwardly into abutment with the front stops 92, 94, 96, 98, 122, 124, 126 and 128. Hydraulic cylinder 86 is then extended so as to raise the front stops thereby permitting one rotor 60 on each of the guide tracks 40, 42, 44 and 46 to roll rearwardly into abutment with the rear stops 132, 134, 136, 138, 158, 160, 162 and 164, which are, at this time, raised and in blocking position. When cylinder 86 is retracted, the rear stops 132, 134, 136, 138, 158, 160, 162 and 164 will be lowered to the positions shown in FIGS. 1 and 2 thereby permitting the four rotors to roll rearwardly onto trays 172, 174, 176 and 178 in the transfer section 170, and from there onto load trays 206, 214, 232 and 302. At the same time, the front stops 92, 94, 96, 98, 122, 124, 126 and 128 will block the next set of four rotors 60 from rolling into mechanism 48. Thus, the escapement mechanism 48 undergoes a two part motion each time a set of four rotors 60 is permitted to advance.

The rotors 60 on load trays 214 and 302 roll directly into compensator sleeves 222 and 226, respectively. The rotors 60 on load trays 206 and 232, however, first strike arms 274, and are decelerated so that they roll into their sleeves 210 and 224 at a lower speed.

The respective plungers 250 are then extended so as to push the rotors 60 forwardly in their sleeves 210, 222, 224 and 226, the molten aluminum is cast around them and the cast rotors are then ejected and the pins 66 pressed out. The above sequence is repeated in cyclical fashion, with only supplying of rotors 60 to guide tracks 40, 42, 44 and 46 in the magazine section 350 necessary on the part of the operator.

While this invention has been described as having a preferred design, it will be understood that it is capable of further modification. This application is, therefore, intended to cover any variations, uses, or adaptations of the invention following the general principles thereof and including such departures from the present disclosure as come within known or customary practice in the art to which this invention pertains and fall within the limits of the appended claims.

What is claimed is:

1. In a die casting machine including at least one die cavity and parts-receiving chamber continuously in communication therewith having a transverse opening therein through which parts are loaded into the parts receiving chamber and then into the die cavity for incorporation into a casting, a parts loader comprising:

a magazine means for supporting a plurality of parts and for advancing the parts along a first portion of a feed path to the opening, a guide track means defining a second portion of the feed path to the opening and having one end thereof aligned with and in close proximity to the opening such that parts moving off the end of the guide track in the feed path will move through the opening, and a selectively actuatable escapement means in the feed path and generally disposed between the magazine means and the guide track means for permitting only one part at a time to advance from the magazine means to the guide track means each time said escapement means is actuated.

2. The apparatus of claim 1 wherein said guide track means includes a portion thereof which is inclined downwardly in a direction toward the opening so that the parts will move toward the opening by gravity.

3. The apparatus of claim 2 wherein said magazine means includes a support track means which guides the parts toward said escapement means and wherein said guide track means includes a portion thereof which is inclined downwardly in a direction toward the escapement means so that the parts will move toward the escapement means by gravity.

4. The apparatus of claim 1 wherein the die casting machine includes a plurality of said die cavity and parts-receiving chambers and respective openings, and said loader includes a plurality of said guide track means aligned with and in close proximity with the respective said openings, and said escapement means simultaneously permits parts to move from said magazine means to respective said guide track means when said escapement means is actuated.

5. The apparatus of claim 4 wherein said magazine means includes a plurality of inclined support track means which guide the parts to said escapement means by gravity, and said escapement means comprises a plurality of front stops adjacent the magazine support track means and a plurality of rear stops adjacent the guide means, and a plurality of inclined transfer surfaces between said front and rear stops and bridging between respective said support track means and respective guide track means, said escapement means including means for moving said rear stops to first positions in blocking relationship to the inclined surface bridging said support track means and said guide track means while at the same time moving said front stops to first positions in non-blocking relationship to parts on said support track means, and for alternatively moving said front stops to second positions in blocking relationship to parts on said support track means while at the same time moving said rear stops to second positions in non-blocking relationship to parts on the inclined surfaces bridging said support track means and said guide track means.

6. The apparatus of claim 1 wherein said magazine means includes an inclined support track means which guides the parts in succession to said escapement means by gravity, and said escapement means comprises a front stop adjacent the magazine support track means and a rear stop adjacent the guide track means, and an inclined transfer surface between said front and rear stops and bridging between said support track means and said guide track means, said escapement means including means for alternatively moving said front stop in and out of blocking relationship to a part on said support track means and alternatively moving said rear stop in and out of blocking relationship to a part on said inclined transfer surface such that a part is first permitted to move to a position on said inclined transfer surface and stopped by said rear stop and then permitted to move onto said guide track means.

7. The apparatus of claim 6 wherein said guide track means is inclined downwardly in a direction toward said opening.

8. The apparatus of claim 1 wherein said guide track means includes a portion including said end which is inclined downwardly toward said opening, and including means in yieldable blocking position in said feed path and in proximity to the inclined portion of said guide track means for decelerating parts as they move along the inclined surface toward said opening.

9. The apparatus of claim 8 wherein said blocking means comprises a pivotally mounted arm which is capable of swinging in and out of blocking position on said inclined portion.

10. The apparatus of claim 1 wherein said guide track means includes a portion including said end which is inclined downwardly toward said opening so that parts move into said opening by gravity and including a magnet means associated with said cavity for holding a ferromagnetic part in said cavity.

11. The apparatus of claim 1 including position sensor means in said cavity for sensing proper positioning of a part in said cavity.

12. The apparatus of claim 1 wherein said magazine means includes at least one pair of elongated guide rails which are laterally adjustable relative to each other, and said guide track means comprises at least one pair of guide rails which are also laterally adjustable relative to each other.

13. The apparatus of claim 1 wherein said die cavity and parts-receiving chamber is a cylindrical sleeve, and said opening is a breech opening into said chamber.

14. A method for loading preformed parts in a die casting machine and incorporating the parts in castings comprising:

providing a die cavity and parts-receiving chamber continuously in communication therewith having a transverse breech opening therein, loading a plurality of the preformed parts in a magazine, moving one part at a time by gravity from the magazine through an escapement mechanism and onto an inclined guide track, moving said one part down the inclined track toward and through the breech opening into the parts-receiving chamber and then into the die cavity, and then introducing molten metal into the cavity to and around at least a portion of the part so loaded.

15. The method of claim 14 including the step of decelerating the part as it moves down the inclined track.

16. The method of claim 15 wherein the part is decelerated by causing it to strike a yieldable element positioned adjacent the guide track.

17. The method of claim 14 including the step of subjecting the part to a magnetic field in the cavity to retain the part in the die cavity.

18. The method of claim 14 including the step of automatically sensing the position of the part in the die cavity.

19. The method of claim 14 wherein the preformed parts are motor rotors having a stack of laminations and a pin extending through the center of the laminations, and wherein the rotors roll by gravity from the magazine, through the escapement mechanism and down the inclined track into the die cavity.

20. The method of claim 14 wherein a plurality of the parts are simultaneously moved through the escapement mechanism and onto a plurality of respective inclined guide tracks, and then moved by gravity down the guide tracks into a plurality of respective die cavities.

* * * * *